US006819031B2

(12) United States Patent
Hori

(10) Patent No.: US 6,819,031 B2
(45) Date of Patent: Nov. 16, 2004

(54) SPARK PLUG AND A METHOD OF PRODUCING THE SAME

(75) Inventor: Tsunenobu Hori, Kariya (JP)

(73) Assignee: Denso Corporation (JP)

( * ) Notice: Subject to any disclaimer, the term of this patent is extended or adjusted under 35 U.S.C. 154(b) by 252 days.

(21) Appl. No.: 09/919,998

(22) Filed: Aug. 2, 2001

(65) Prior Publication Data

US 2002/0017846 A1 Feb. 14, 2002

(30) Foreign Application Priority Data

Aug. 2, 2000 (JP) ..... 2000-234547

(51) Int. Cl.[7] ..... H01T 13/20
(52) U.S. Cl. ..... 313/141; 313/140; 313/118
(58) Field of Search ..... 445/7; 123/153, 123/169 EL, 163; 313/141, 140, 143, 118

(56) References Cited

U.S. PATENT DOCUMENTS 5,465,022 A * 11/1995 Katoh et al. ..... 313/144
6,078,129 A * 6/2000 Gotou et al. ..... 313/141
6,346,766 B1 * 2/2002 Kanao et al. ..... 313/141

FOREIGN PATENT DOCUMENTS

| | | |
|---|---|---|
| EP | 0872928 A1 | 10/1998 |
| EP | 1168542 A1 | 1/2001 |
| EP | 1133037 A2 | 9/2001 |
| JP | A-6-188062 | 7/1994 |
| JP | 11-3765 | 1/1999 |
| JP | 2001-60488 | 6/2001 |

* cited by examiner

*Primary Examiner*—David V. Bruce
*Assistant Examiner*—Elizabeth Keaney
(74) *Attorney, Agent, or Firm*—Nixon & Vanderhye PC

(57) ABSTRACT

Reliability in connection between a chip and a base material (at least one of the central electrode and the ground electrode) of a spark plug is improved by forming a plurality of welding layers at connection between the chip and the base material in a distance increasing direction from the central electrode with overlap. With respect to section along the connection surface the sum of the sectional area of the first weld layer and the second weld layer at the overlap portion between the first and second weld layers is equal to or greater than 1.4 times the sectional are of the chip. A stress releasing layer of which linear expansion coefficient is between those of the chip and the base material may be provided between the chip and the base material for welding.

7 Claims, 16 Drawing Sheets

SECTION A—A

SECTION A—A

SECTION B—B

FIG. 5

| SAMPLE TYPE | DEPTH $d_1$ | DEPTH $d_2$ | RATIO OF SECTIONAL AREAS |
|---|---|---|---|
| ① | 0.3 | 0.1 | 0.73 |
| | | 0.2 | 0.88 |
| | | 0.3 | 1.01 |
| ② | 0.7 | 0.1 | 1.12 |
| | | 0.3 | 1.4 |
| | | 05 | 1.71 |
| | | 0.7 | 1.79 |
| ③ | 1.1 | 0.1 | 1.28 |
| | | 0.3 | 1.56 |
| | | 0.5 | 1.87 |
| | | 0.7 | 1.95 |
| | | 0.9 | 2.06 |
| | | 1.1 | 2.1 |

FIG. 6
PRIOR ART

| SAMPLE TYPE | DEPTH $d_1$ | RATIO OF SECTIONAL AREAS |
|---|---|---|
| ④ | 0.1 | 0.29 |
| ⑤ | 0.3 | 0.57 |
| ⑥ | 0.5 | 0.88 |
| ⑦ | 0.7 | 0.96 |
| ⑧ | 0.9 | 1.07 |
| ⑨ | 1.1 | 1.12 |
| ⑩ | 1.3 | 1.13 |

FIG. 9

| SAMPLE TYPE | DEPTH $d_1$ | DEPTH $d_2$ | DEPTH $d_3$ | RATIO OF SECTIONAL AREAS |
|---|---|---|---|---|
| ⑪ | 0.3 | 0.1 | 0.1 | 0.89 |
| | | 0.2 | 0.1 | 1.04 |
| | | | 0.2 | 1.19 |
| | | 0.3 | 0.1 | 1.17 |
| | | | 0.2 | 1.32 |
| | | | 0.3 | 1.45 |
| ⑫ | 0.7 | 0.1 | 0.1 | 1.28 |
| | | 0.2 | 0.1 | 1.43 |
| | | | 0.2 | 1.58 |
| ⑬ | 1.1 | 0.1 | 0.1 | 1.44 |

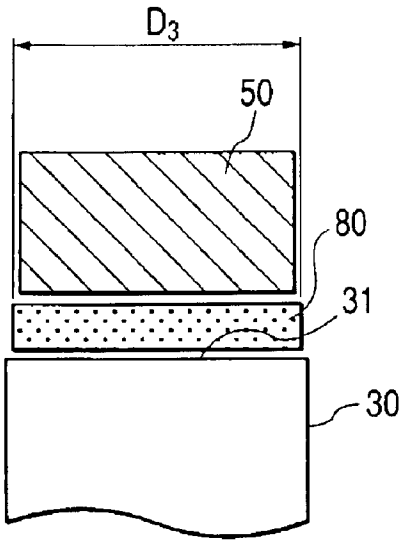
FIG. 12C
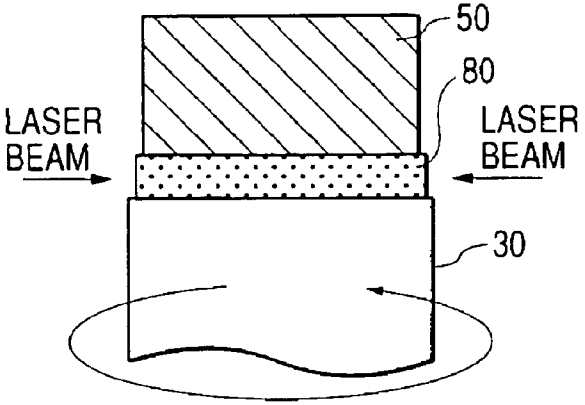
FIG. 12B
FIG. 12A

FIG. 13

| SMPL. TYPE | DEPTH $d_4$ | RATIO $\alpha$ OF SECTIONAL AREAS |
|---|---|---|
| ⑭ | 0.1 | 0.29 |
| ⑮ | 0.3 | 0.57 |
| ⑯ | 0.5 | 0.88 |
| ⑰ | 0.7 | 0.96 |
| ⑱ | 0.9 | 1.07 |
| ⑲ | 1.1 | 1.12 |
| ⑳ | 1.3 | 1.13 |

SPARK PLUG AND A METHOD OF PRODUCING THE SAME

BACKGROUND OF THE INVENTION

1. Field of the Invention

This invention relates to a spark plug including a chip for spark discharge on at least one of the central electrode and the ground electrode and a method of producing the spark plug.

2. Description of the Prior Art

A spark plug including a chip for spark discharge on at least one of the central electrode and the ground electrode is disclosed in Japanese patent application provisional publications Nos. 6-188062 and 11-3765. Such a prior art spark plug includes a chip for spark discharge on a base material which is at least one of the ground electrode and the central electrode by laser welding. The chip includes noble metal or an alloy including noble metal. The laser welding between the chip and the base material forms a welding portion at an interface between the chip and the base material, wherein there is a large difference in linear expansion coefficient between the chip (Ir alloy, Pt alloy, or the like) and the base material (Ni-base alloy or the like). Because the chip is fixed to the base material through the welding portion by the laser welding, the chip is fixed to the base material with a weld (melted and solidified) portion, so that the laser welding has a higher reliability of connection than the resistance welding.

However, recently, a further higher reliability is still required because the chip size chip increases and the heat load in the ending increases progressively.

In the above-mentioned Japanese patent application provisional publication No. 11-3765, a plurality of welding portions are formed so as to be arranged in the distance increasing direction from the base material to make it thicker and to reduce the difference in the linear expansion coefficient between the chip and the base material to modulate the thermal stress to the connection portion. This Japanese patent application provisional publication only discloses the outline of the welding portions and fails to disclose the sectional structure and the details.

SUMMARY OF THE INVENTION

The aim of the present invention is to provide a superior spark plug and a superior method of producing a spark plug.

According to the present invention, a first aspect of the present invention provides a spark plug comprising: a tubular housing; a central bar electrode supported by said tubular housing in said tubular housing with electrical insulation therebetween; and a ground electrode extending from one end of said tubular housing; a chip, arranged at an end surface of a base material which is at least one of said central bar electrode and said ground electrode for spark discharge through said central bar electrode and said ground electrode, said chip including a noble metal, and a weld portion between said base material and said chip including first to $n^{th}$ weld layers formed by materials of said chip and said base material by laser welding to fix said chip to said base material, wherein said first to $n^{th}$ weld layers are successively arranged from a side of said base material in order of said first to $n^{th}$ weld layers in a distance increasing direction from said base material which is substantially perpendicular to said end surface, each of said first to $n^{th}$ weld layers has at least an overlap portion with a neighbor of said first to $n^{th}$ weld layers, a sum of a maximum first sectional area of said first layer and second sectional areas of said second to $n^{th}$ weld layers at said overlap portions is 1.4 times a third sectional area of said chip, said first, second, and third sectional areas are along said end surface, and n is a natural number more than one.

According to the present invention, a second aspect of the present invention provides a spark plug based on the first aspect, wherein said $m^{th}$ weld layer has a maximum fourth sectional area along said end surface which is greater than said second sectional area of said $m^{th}$ weld layer at said overlap portion between said $m^{th}$ and $(m-1)^{th}$ weld layer, $2 \leqq m \leqq n$, and m is a natural number.

According to the present invention, a third aspect of the present invention provides a spark plug based on the first aspect, wherein said chip includes Ir of more than 50% by weight.

According to the present invention, a fourth aspect of the present invention provides a spark plug comprising: a tubular housing; a central bar electrode supported by said tubular housing in said tubular housing with electrical insulation therebetween; a ground electrode extending from one end of said tubular housing; a stress releasing layer, arranged on an end surface of a base material which is at least one of said central bar electrode and said ground electrode; a chip, being arranged on said stress releasing layer and including a noble metal, for spark discharge through said central bar electrode and said ground electrode; and a weld portion formed between said base material and said chip with materials of said base material, said stress releasing layer, and said chip by laser welding to fix said chip to said base material, wherein a linear expansion coefficient of said stress releasing layer is between those of said base material and said chip.

According to the present invention, a fifth aspect of the present invention provides a spark plug based on the fourth aspect, wherein a thickness t of said stress releasing layer is equal to or greater than 0.2 mm and equal to or smaller than 0.6 mm and $\alpha > (1.4-t)/2$ where $\alpha$ is a ratio of a maximum sectional area of said weld portion along said end surface to a sectional area of said chip along said end surface.

According to the present invention, a sixth aspect of the present invention provides a spark plug based on the fourth aspect, wherein said chip includes Ir of more than 50% by weight.

According to the present invention, a seventh aspect of the present invention provides a method of producing a spark plug including a tubular housing, a central bar electrode supported by said tubular housing in said tubular housing with electrical insulation therebetween, and a ground electrode extending from one end of said tubular housing, comprising the steps of: providing a stress releasing layer on a side of said one end of said tubular housing on an end surface of a base material which is at least one of said central bar electrode and said ground electrode; providing a chip including a noble metal for spark discharge on said stress releasing layer and having a linear expansion coefficient between those of said base material and said chip; and fixing said chip to said base material by forming a weld layer at an interface portion of said base material, said stress releasing layer, and said chip.

According to the present invention, an eighth aspect of the present invention provides a spark plug based on said fourth aspect, wherein said weld portion includes first and second ring shape layers, said first ring shape layer is arranged between a portion of the end surface 31 of said base material and said stress releasing layer to fix said stress releasing layer to said base material, said second ring shape layer is arranged between said chip and said stress releasing layer to fix said chip to said stress releasing layer.

According to the present invention, a ninth aspect of the present invention provides a spark plug comprising tubular housing; a central bar electrode supported by said tubular housing in said tubular housing with electrical insulation therebetween; a ground electrode extending from one end of said tubular housing, at least one of said central bar electrode and said ground electrode servicing as a base material; a weld portion on said base material; and a chip on said weld portion, including a noble metal for spark discharge through said central bar electrode and said ground electrode; wherein a linear expansion coefficient of said weld portion is between those of said base material and said chip.

According to the present invention, a tenth aspect of the present invention provides a spark plug based on the fourth aspect, wherein said weld portion is arranged around said stress releasing layer.

BRIEF DESCRIPTION OF THE DRAWINGS

The object and features of the present invention will become more readily apparent from the following detailed description taken in conjunction with the accompanying drawings in which:

FIG. 5 is a table of test samples showing variation in ratio of the sectional areas with respect to depths of welding layers in the two-weld-layer structure according to the first embodiment;

FIG. 6 is a table of a prior art test samples showing variation in ratio of the sectional areas with respect to depth d1 of welding layer in a prior art single-weld-layer structure;

FIG. 9 is a table of test samples showing variation in ratio of the sectional areas with respect to depths of welding layers in the three-weld-layer structure according to the first embodiment;

FIGS. 12A to 12C are sectional side elevation views of the tip portion of the central electrode to show welding portion according to the second embodiment;

FIG. 13 is a table of test samples showing variation in ratio of the sectional areas with respect to depths of welding layers in the three-weld layer structure according to the second embodiment;

The same or corresponding elements or parts are designated with like references throughout the drawings.

DETAILED DESCRIPTION OF THE INVENTION

[First Embodiment]

The spark plug according to the first embodiment is used in a gas engine for a electric generator in a cogeneration system.

Figure 1:
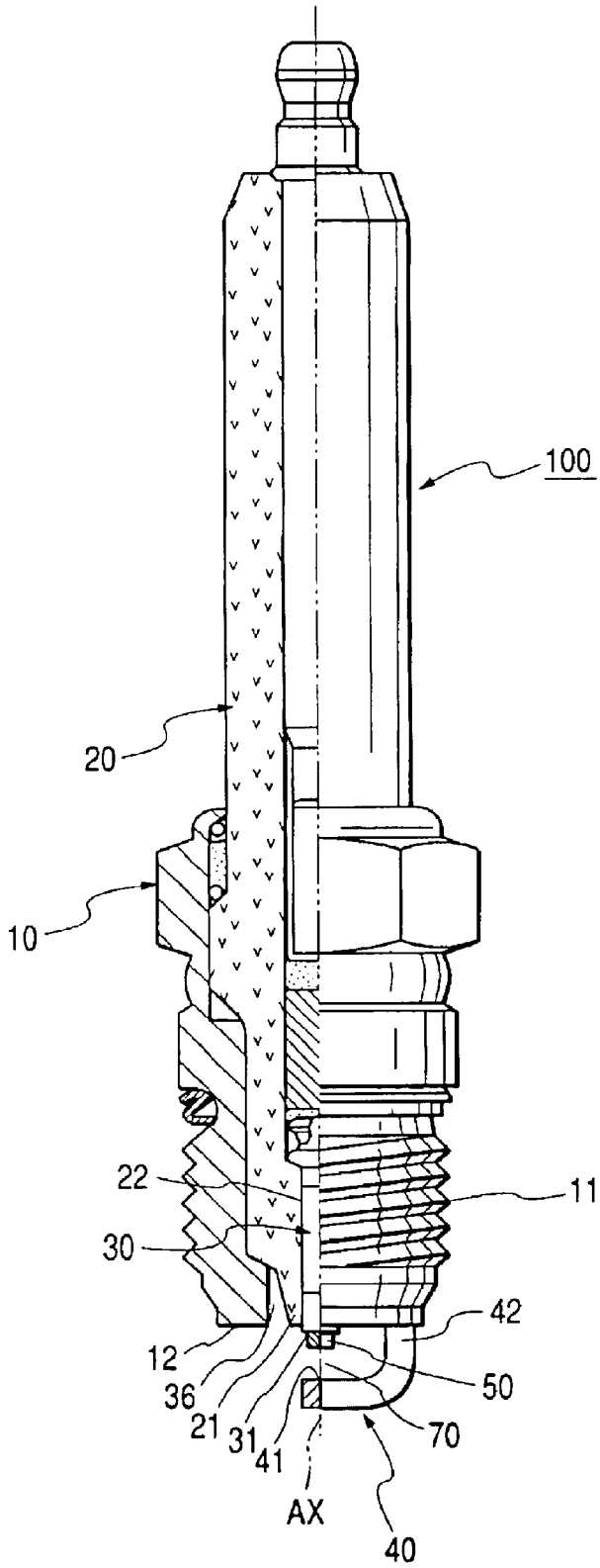
FIG. 1 is a side elevation view, partly in cross section, of a spark plug according to a first embodiment.

FIG. 1 is a side elevation view, partly in cross section, of a spark plug 100 according to the first embodiment.

Figure 2A:
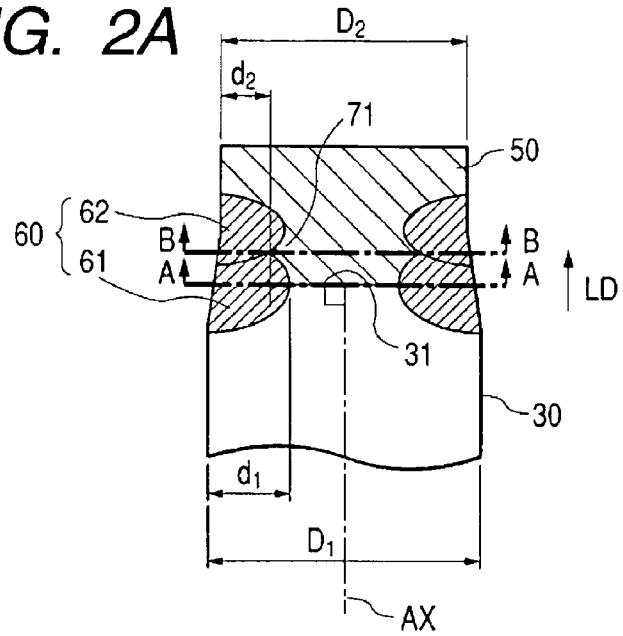
FIG. 2A is a sectional side elevation view of an example of the connection portion between the central electrode and the chip along an axis AX of the central electrode according to the first embodiment.
Figure 2B:
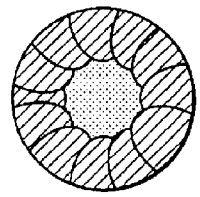
FIG. 2B is a sectional plan view taken on the line A—A in FIG. 2A.
Figure 2C:
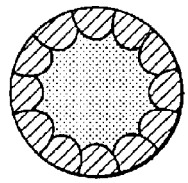
FIG. 2C is a sectional plan view taken on the line B—B in FIG. 2A.
Figure 3:
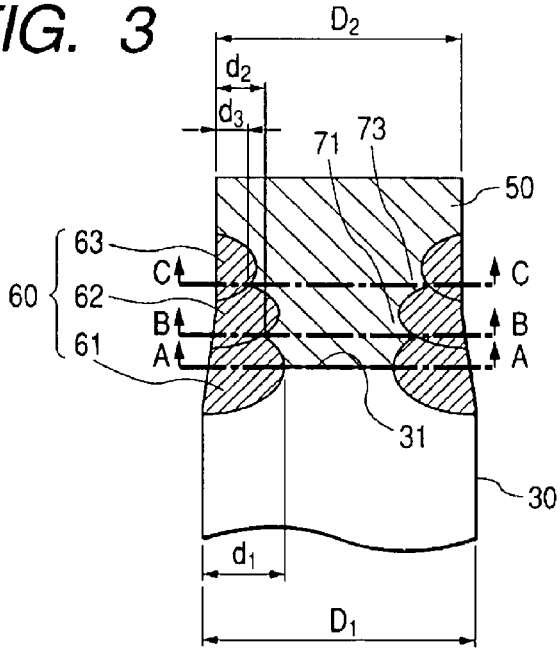
FIG. 3 are sectional side elevation views of examples of the connection portion between the central electrode and the chip along an axis AX of the central electrode according to the first embodiment.

In this embodiment, for example, the chip 50 is welded by laser to a central electrode 30 as a base material. That is, the chip 50 may be provided to the ground electrode 40 or the chips may be provided to both of the ground electrode 40 and the central electrode 30. FIGS. 2A and 3 are sectional side elevation views of examples of the connection portion between the central electrode 30 and the chip 50 on a plan along an axis AX of the chip 50. FIG. 2B is a sectional plan view taken on the line A—A in FIG. 2A. FIG. 2C is a sectional plan view taken on the line B—B in FIG. 2A. In this embodiment, at least one of the central electrode 30 and the ground electrode 40 serves as a base material.

The spark plug 100 includes a tubular metal housing 10 having an inner hole 36 therein and has a thread portion 11 for mounting on an engine block (not shown). The housing 10 supports an insulator 20 made of alumina ceramics ($Al_2O_3$) or the like in the inner hole 36 of the housing 10. A tip 21 of the insulator is exposed to the space at one end 12 of the housing 10.

The insulator 20 supports the central electrode 30 in an axial hole 22 of the insulator 20, so that the housing 10 supports the central electrode 30 with insulation. A tip 31 of the central electrode 30 is exposed to the space at one end 12 of the housing 10. The central electrode 30 is a bar and includes an inner material and an outer material around the inner material. The inner material includes a metallic material having a superior heat conductivity such as Cu. The outer material includes a metallic material having a superior heat resistance and a superior corrosion resistance such as Ni-base alloy. In this embodiment, the central electrode 30 has a cylindrical shape.

One end 41 of the ground electrode 40 substantially confronts one end of the central electrode 30, an intermediate portion of the ground electrode is bent, and the other end 42 of the ground electrode is welded to one end 12 of the housing 10. That is, the ground electrode 40 extends from the one end 12 of the housing.

At the end surface (connecting surface) 31 of the central electrode, a chip 50 including noble metal or an alloy including the noble metal is welded to the central electrode as a base material by the laser welding with forming weld portion 60 by the laser welding. That is, the weld portion 60 connects the chip 50 to the central electrode 30. The weld portion 60 is provided by melting materials of the chip 50 and the central electrode 30 by the laser welding and then, the melted solidified.

The chip 50 and one end 41 of the ground electrode 40 provides a gap 70 for spark discharge. The chip 50 is a circular plate made of Ir (Iridium), an Ir alloy, Pt (platinum), a Pt alloy or the like. In consideration of the heat resistance, it is favorable that the chip 50 includes Ir of equal to or more than 50% by weight.

More specifically, the spark plug 100 includes the tubular housing 10, the central bar electrode 30 supported by the tubular housing 10 in the hole 36 of the tubular housing 10 with electrical insulation therebetween; and the ground electrode extending from the one end 12 of the tubular housing 10. One end of the central electrode 30 substantially confronts one end 41 of the ground electrode 40. The chip 50 is arranged at the end surface 31 of the base material which is at least one of the central bar electrode 30 and the ground electrode 40, on a side of the one end 12 of the tubular housing 10, for spark discharge through the central bar electrode 30 and the ground electrode 40. The chip 50 includes a noble metal.

With reference to FIGS. 2A to 2C and FIG. 3, the structure of the connection portion between the chip 50 and the central electrode (base material) 30 will be described. In this embodiment the weld portion (alloy portion) 60 is formed such that the weld portion 60 includes first to $n^{th}$ weld layers, and the chip 50 is fixed to the base material with the weld portion 60, the first to $n^{th}$ weld layers are successively arranged from a side of the base material (central electrode 30) in order of the first to $n^{th}$ weld layers along the axis AX of the base material (in the distance increasing direction from the base material), wherein n is a natural number more than one. Each of the first to $n^{th}$ weld layers has at least an overlap portion B with a neighbor of the first to $n^{th}$ weld layers (61) as shown in FIG. 2A.

The structure of the welding portion can be observed with a metallurgical microscope at sectional surface.

FIG. 2A shows an example of two-layer structure, wherein first and second weld layers 61 and 62 are arranged from the side of the central electrode 30 in this order. At first, the first weld layer 61 is formed by laser wherein portions (materials) of the chip 50 and the central electrode 30 are melted and alloyed, and then, solidified. FIG. 2B shows the sectional view of the first weld layer 61. Next, the second layer 62 is similarly formed with the overlap portion B. FIG. 2C shows the section of the second weld layer at the overlap portion.

FIG. 3 shows an example of three-layer structure, wherein first and second weld layers 61 to 63 are successively formed from the side of the central electrode 30 in this order. Therefore, there are overlap portions B and C are provided. The number of the layers may be four or more.

Each of weld layers 61 to 63 has a ring shape viewed along the axis AX. The ring shape may be successively connected therearound or may be intermittently connected therearound.

More specifically, a plurality of weld layers 61 to 63 are formed as follows:

The chip 50 is temporarily fixed to the end surface 31 of the central electrode 30 by the resistance welding or temporarily fixed with a jig. Next, laser hits the interface between the chip 50 and the central electrode 30 around full circumference of the interface or at parts of the circumference. This forms the first weld layer 61.

Next, the spot of the laser is shifted along the axis AX, and the laser hits the interface portion similarly to form the second weld layer 62. In the example shown in FIG. 3, the third weld layer 63 is further formed.

As mentioned above, materials of the chip 50 and the central electrode 30 are melted and mixed as an alloy, and solidified to form the weld portion 60. Each of the weld layers 61 to 63 protrudes from the outer surface at the interface portion toward the axis AX such tips of the weld layers intrudes the central electrode 30 or the chip 50. Here, in the examples shown in FIG. 2A and FIG. 3, the first to third weld layers 61 to 63 (62) are formed in this order. However, order of forming the weld layers 61 to 63 can be changed.

In this embodiment, sectional areas at the weld portion 60 along the connecting surface 31 are provided as follows:

A sum of a maximum first sectional area of the first weld layer on A—A plane and the second sectional areas of the second weld layers at the overlap portion on B—B plane is 1.4 times the sectional area of the chip 50. The first and second sectional areas are along the end surface 31 or perpendicular to the axis AX.

In the embodiment shown in FIG. 3, the sum of a maximum first sectional area of the first weld layer on A—A plane and second sectional areas of second and third weld layers at the overlap portions on B—B and C—C planes is 1.4 times the sectional area of the chip 50. The first, second, and third sectional areas are along (in parallel to) the end surface 31 or perpendicular to the axis AX.

The maximum sectional are of the first weld layer 61 is sectional area along the end surface 31 with the maximum depth d1 intruding of the weld layer 61 into the central electrode 30 or the chip 50 on the plane A—A which is perpendicular to the axis Ax or parallel to the end (connecting) surface 31.

Figure 4A:
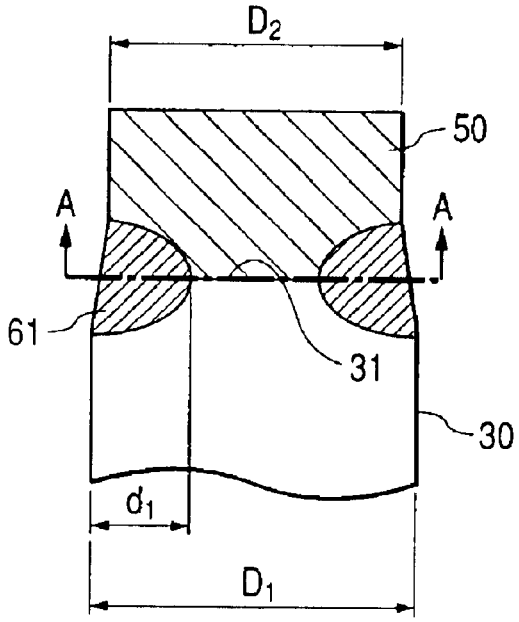
FIG. 4A PRIOR ART
FIGS. 4A and 4B are sectional side elevation views of prior art spark plugs for comparison with the first embodiment.
Figure 4B:
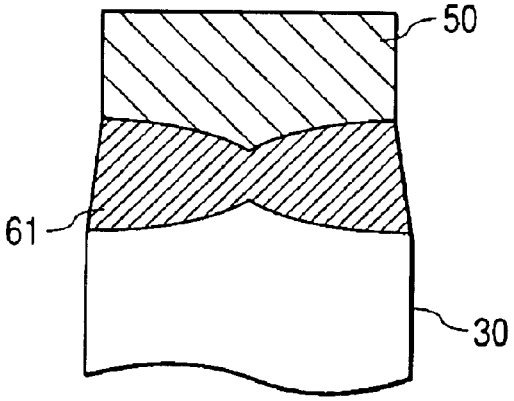
FIG. 4B PRIOR ART

The inventor discovered the relation of sectional areas from experiments. Study about this relation with the example shown in FIG. 2A will be described. FIGS. 4B and 4B are partial sectional side elevation views of the central electrode 30 of a prior art spark plug. The single-weld-layer structures shown in FIGS. 4A and 4B are provided for comparison with the first embodiment.

In this experiment, the central electrode 30 comprises a Ni-base alloy, i.e., inconel (registered trademark), and a diameter D1 of the one end surface 31 is 2.7 mm. The chip 50 comprises Ir-10Rh which is an alloy including 90% Ir and 10% Rh by weight. A circular plate chip having a diameter D2 of 2.4 mm and the thickness is 1.4 mm is used. These specifications of the central electrode 30 and the chip 50 are general for the spark plug for the cogeneration system of which heat load is heavy.

For the two-weld-layer structure, variation of the laser welding condition changes the dept d1 of the first weld layer 61 and the depth d2 at the overlap portion between the first and second weld layers 61 and 62 to provide various ratios of the sectional areas in the test sample. Then, data of the ratio of a sum of a maximum first sectional area of the first layer 61 and second sectional areas of second to $n^{th}$ weld layers at the overlap portions B, C to the third sectional area of the chip 50 is obtained.

FIG. 5 is a table of test samples showing variation in ratio of the sectional areas with respect to depths of welding layers in the two-weld layer structure. In sample type ①, the depth d1 is 0.3 mm, and the depth d2 at the overlap portion is varied from 0.1 to 0.3 mm. In sample type ②, the depth d1 is 0.7 mm, and the depth d2 is varied from 0.1 to 0.7 mm. In sample type ③, the depth d1 is 1.1 mm, and the depth d2 is varied from 0.1 to 1.1 mm.

FIG. 6 is a table of a prior art test samples showing variation in ratio of the sectional areas with respect to depth d1 of welding layer in the single-weld-layer structure for comparison with test samples in FIG. 5. In the single-weld-layer structure, changing the laser welding condition varies the depth d1 of the weld layer 61 to provide various sectional areas of the weld layer 61. Next, the ratios of the sectional area of the weld layer to the sectional area of the chip 50 are observed.

In sample types ④ to ⑩, the depths d1 are 0.1, 0.3, 0.5, 0.7, 0.9, 1.1, and 1.3 mm, respectively. The types ④ to ⑨ have the ring type weld layer structure viewed along the axis AX. The type ⑩ has a circler plate type of weld layer (welded in full depth) as shown in FIG. 4B (viewed along the axis AX).

These test types of spark plugs in FIGS. 5 and 6 are subjected to an endurance test to estimate the reliability in connection between the chip 50 and the central electrode 30. The endurance test is performed by mounting spark plugs on a engine having six cylinders with a displacement of 2000 cc. The operation condition is as follows:

A set operation includes idling which is kept for one minute, and full throttle running (6000 rpm) which is kept for one minute, and this set is repeated for a hundred hours. The reliability in connection is estimated in a tensile strength, and it is judged that the actual connection reliability is provided if the tensile strength is more than 200N after the above-mentioned endurance test.

Figure 7:
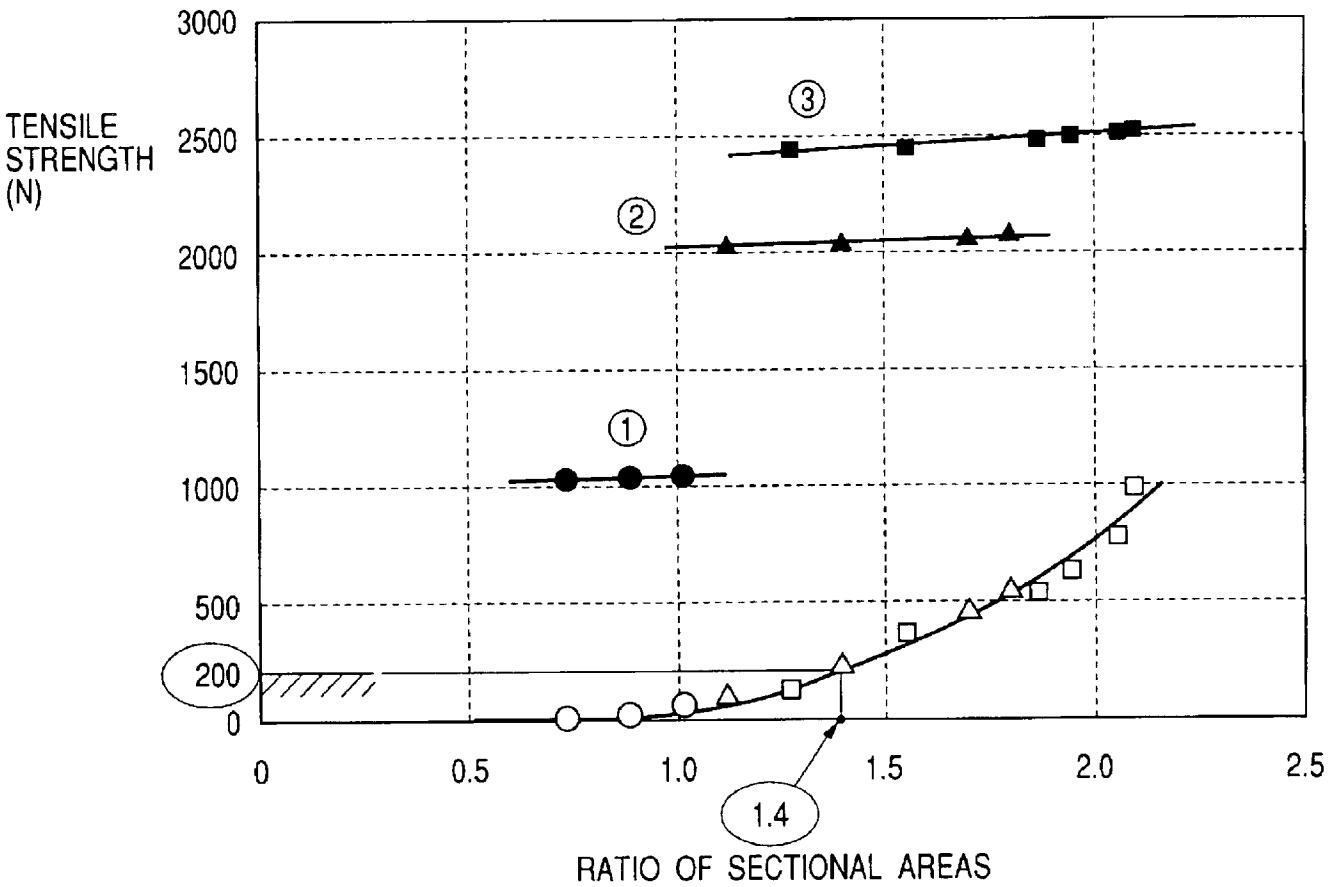
FIG. 7 is a graphical drawing showing variation in tensile strength (N) with respect to the ratio of the sectional areas of the weld layers and chip without and with the endurance test in the two-weld-layer structure according to the second embodiment.

FIG. 7 is a graphical drawing showing variation in tensile strength (N) with respect to the ratio of the sectional areas of the weld layers 61 and 62 and the chip 50 without and with the endurance test in the two-weld-layer structure. In FIG. 7, round dots represent the tensile strengths for the type ① without endurance test and circles represent those after the endurance test. Triangle-shape dots represent the tensile strengths for the type ② without endurance test and small triangles represent those after the endurance test. Square dots represent the tensile strengths for the type ③ without endurance test and small squares represent those after the endurance test.

Figure 8:
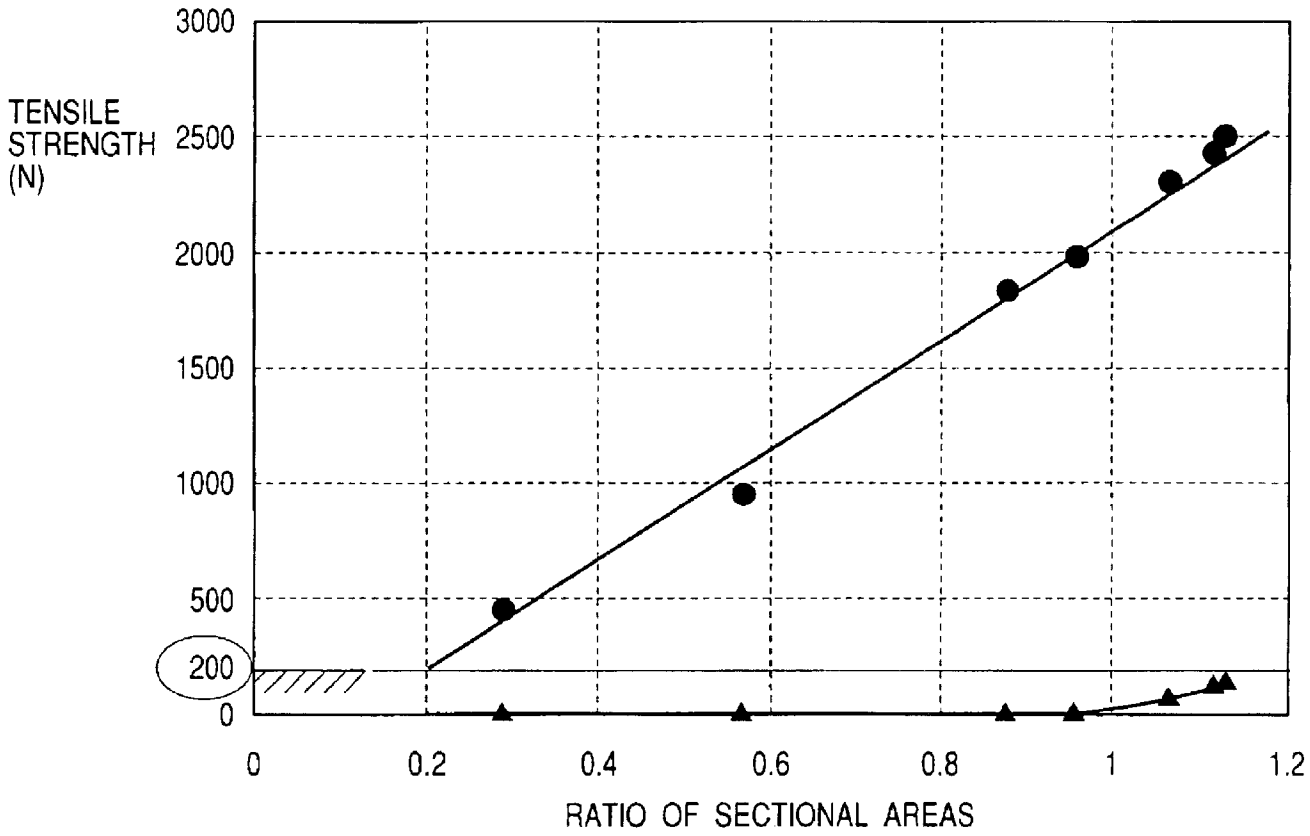
FIG. 8 PRIOR ART
FIG. 8 shows variation in tensile strength (N) with respect to the ratio of the sectional area of the weld layer and the chip without and with the endurance test in the prior art single-weld-layer structure.

On the other hand, FIG. 8 shows variation in tensile strength (N) with respect to the ratio of the sectional area of the weld layer and the chip 50 without and with the endurance test in the single-weld-layer structure. In FIG. 8, round dots represent the tensile strengths without endurance test and triangle-shape dots represent those after the endurance test.

As clearly shown in FIG. 8, in the single-weld-layer structure without endurance test, the tensile strength varies with the sectional area of the weld layer. However, the tensile strength after the endurance test cannot reach the actual allowance level of 200 N even in the case of the welded-in-full-depth-structure (FIG. 4B) showing the highest reliability among the single-weld-layer structures.

On the other hand, as shown in FIG. 7, in the two-weld-layer structure without the endurance test, the tensile strength varies with the total sectional area. However, after the endurance test, the tensile strength increases with the ratio of the total sectional area of the weld layers to the sectional area of the chip 50 irrespective of the sectional shape of the weld portion 60.

This is because the thickness of the weld portion 60 having the two-weld-layer structure is made larger than the single-weld-layer structure as well as difference in linear expansion coefficient between the chip 50 and the central electrode (base material) 30 can be reduced, so that the thermal stress to the connection portion can be reduced. Moreover, if the ratio of sectional areas (total sectional area) is equal to or greater than 1.4 times the sectional area of the chip 50, the tensile strength can be obtained more than 200 N, that is the reliability in connection is provided in the actual use level.

Moreover, the three-layer structure shown in FIG. 3 is also estimated. The test types are similar to those in the two-layer structure. That is, test samples are prepared of which the depth d1 of the first weld layer 61, the depth d2 of the second weld layer at the overlap portion, and the depth d3 of the third weld layer at the overlap potion are varied as shown in FIG. 9.

For each of the tested samples, the total of the sectional areas of the first weld-layer 61, the sectional area of the second weld layer at the overlap portion between the first and second weld layers 61 and 62, and the sectional area of the third weld layer 63 at the overlap portion between the second and third weld layers 62 and 63 is calculated. FIG. 9 also shows the ratios of the total sectional areas to the sectional are of the chip 50 for respective test samples.

In FIG. 9, the sample type ⑪, the depth d1 is 0.3 mm, the depth d2 at the overlap portion B is varied from 0.1 to 0.3 mm, and the depth d3 at the overlap portion C is varied from 0.1 to 0.2 mm. In sample type ⑫, the depth d1 is 0.7 mm, the depth d2 is varied from 0.1 to 0.3 mm, and the depth d3 at the overlap portion C is varied from 0.1 to 0.3 mm. In the sample type ⑬, the depth d1 is 1.1 mm, and the depth d2 is 0.1 mm, and the depth d3 is 0.1 mm.

These test samples are subjected the endurance test similarly. The reliability in connection is estimated with respect to a tensile strength.

Figure 10:
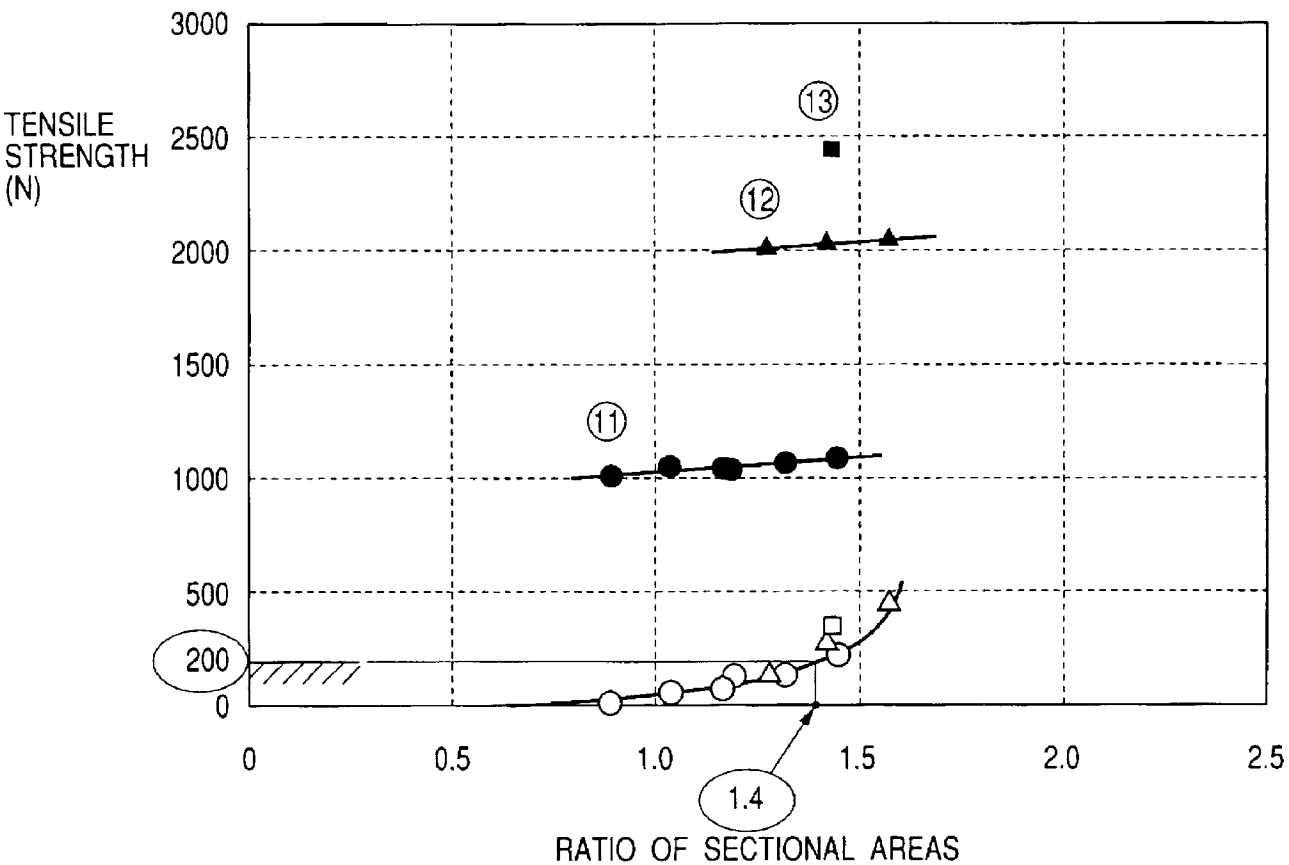
FIG. 10 is a graphical drawing showing variation in tensile strength (N) with respect to the ratio of the sectional areas of the weld layers and chip with and without the endurance test in the three-weld-layer structure according to the first embodiment.

FIG. 10 is a graphical drawing showing variation in tensile strength (N) with respect to the ratio of the sectional areas of the weld layers 61 to 63 and the chip 50 without and with the endurance test in the three-weld-layer structure. In FIG. 10, round dots represent the tensile strengths for the test type ⑪ without endurance test and circles represent those after the endurance test. Triangle-shape dots represent the tensile strengths for the type ⑫ without endurance test and small triangles represent those after the endurance test. Square dots represent the tensile strengths for the type ⑬ without endurance test and small squares represent those after the endurance test. As clearly shown in FIG. 10, the same operation as the two-weld-layer structure can be provided.

From the above-mentioned study, the reliability in connection between the chip 50 and the central electrode 30 can be obtained at the actual level by making the total of the sectional area of the first weld-layer 61 and the sectional areas of the second to $n^{th}$ weld layers at overlap portions 1.4 times the sectional area of the chip 50.

Moreover, this embodiment, it is favorable that $m^{th}$ weld layer ($2 \leqq m \leqq n$) has a sectional area along to the connection surface 31 which is larger than the sectional area at the overlap portion B or C. That is, viewed on a plane including the axis AX, the $m^{th}$ weld layer has a peak which protrudes toward the axis AX into the chip 50.

The examples in FIGS. 2A and 3 have this favorable structure, i.e., a wedge structure. More specifically, in the two-layer-structure, the sectional area A of the second weld layer 62 is greater than the sectional area at the overlap portion B between the first and second weld layers 61 and 62. In the three-layer structure, the sectional area of the third weld layer 63 is greater than the sectional area at its overlap portion C between the second and third weld layers 62 and 63.

Each of weld layers 61 to 63 is formed (melted and solidified) from the outer surface toward the center. For example, the tip of the second layer 62 projects into the material of the chip 50 toward the center of the chip 50 from the depth d2 of the overlap portion B between the first and second weld layers 61 and 62.

In other words, wedge portion 71 of the chip projects into the weld portion 60. The second weld layer 62 catches this wedge portion 70. This prevents the chip 50 from being disconnected from the central electrode 30.

In the three-layer structure shown in FIG. 3, another wedge portion 73 is further provided between the second and third weld layers 62 and 63. This provides a stronger wedge structure.

If the number of weld layers is more than two, there may be the case that all weld layers except the first weld layer 61 have this structure. However, there is the wedge effect if at least one of weld layers except the first weld layer has this stricture.

[Second Embodiment]

Figure 11A:
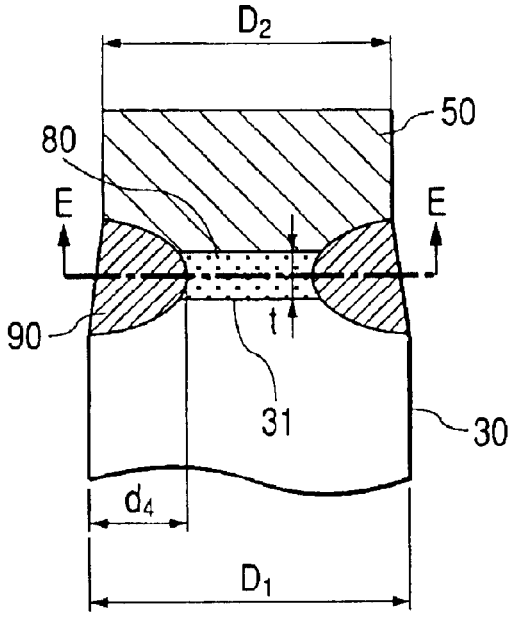
FIGS. 11A and 11B are sectional side elevation views of the connection portion between the chip and the central electrode according to the second embodiment.

FIG. 11A shows a tip portion of the central electrode 30 according to the second embodiment in a sectional side elevation view.

Figure 11B:
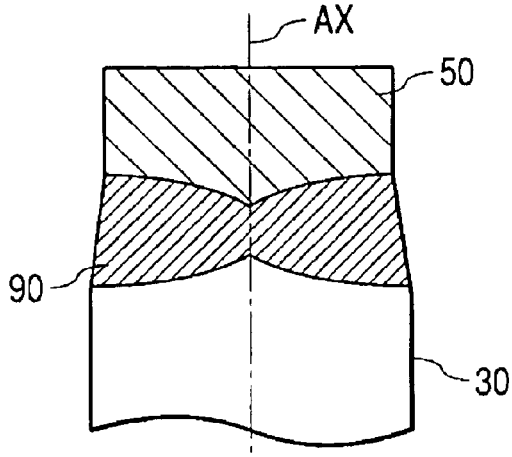

The spark plug according to the second embodiment has substantially the same structure as the first embodiment. The difference is that a stress releasing layer (moderation layer) 80 is further provided between the chip 50 and the end surface 31 of the central electrode (base material) 30. That is, the stress releasing layer 80 is sandwiched between the chip 50 and the end surface 31 of the central electrode 30 to reduce thermal stress between the chip 50 and the central electrode 30. The stress releasing layer 80 has a linear expansion coefficient which is between those of the chip 50 and the central electrode 30. The chip 50 is fixed to the central electrode 30 by the weld layer 90 formed at the interface portion of the central electrode 30, the stress releasing layer 80 and the chip 50 from materials of the chip 50, the stress releasing layer 80 and the central electrode 30 by the laser welding. FIG. 11B shows a tip portion of the central electrode 30 wherein laser welding is effected with full depth (radius of the central electrode 30). That is, the weld layer 90 is formed in a circular plate viewed along the axis AX. Thus, the weld portion is arranged on the base material. The chip 50 is arranged on the weld portion, wherein a linear expansion coefficient of the weld portion is between those of the base material and the chip 50.

If the central electrode 30 comprises a Ni-base alloy, and the chip 50 comprises Ir or an Ir alloy, a Pt alloy or the like can be used as the material of the stress releasing layer 80, wherein the linear expansion coefficient of the Pt alloy exists between those of the Ni-base alloy and the Ir alloy. As such a Pt alloy, Pt-20Ir-2Ni (alloy includes 78% Pt, 20% Ir, and 2% Ni) is used.

FIGS. 12A to 12C are sectional side elevation views of the connection portion of the central electrode to show the welding operation.

At first, the modulation layer 80 is sandwiched between the chip 50 and the end surface 31 of the central electrode 30, and these three parts are temporarily fixed. The resistance welding or a jig provides the temporarily fixing. Next, a laser beam is hit at or around the stress releasing layer 80 such that the interfaces between the chip 50 and the stress releasing layer 80 and between the modulation layer and the central electrode 30 are eliminated to form the weld layer 90. As a result, the welded structure is provided as shown in FIG. 12C.

The stress releasing layer 80 between the chip 50 and the end surface 31 of the central electrode 30 reduces the thermal stress due to difference in the linear expansion coefficient between the chip 50 and the central electrode 30. This improves the reliability in connection between the chip 50 and the central electrode 30.

Here, it is favorable that the thickness of the stress releasing layer 80 is equal to or greater than 0.2 mm and equal to or smaller than 0.6 mm. Moreover, it is assumed that a ratio $\alpha$, is derived by dividing the sectional area at the maximum depth of the weld layer 90 on the plane (E—E section in FIG. 11A) along the end surface 31 by the sectional area of the chip 50. It is favorable that $\alpha$ is equal to or greater than $(1.4-t)/2$. This condition provides sufficient reliability in connection between the chip 50 and the base material.

This relation of the ratio $\alpha$ was determined in accordance with the result of experiments done by the inventor. The study of the experiments will be described.

As the central electrode 30, a bar having a diameter D1 of 2.7 mm at the end surface 31, as the chip 50, a circular chip made of Ir-10 Rh having a diameter D2 of 2.4 mm, and thickness of 1.4 mm, and as the stress releasing layer 80, a circular plate made of Pt-20Ir-2Ni having a diameter D3 of 2.4 mm are used.

Here, the reason why the thickness of the stress releasing layer 80 is limited in the range from 0.2 to 0.6 is that if the thickness is smaller than 0.2 mm, there is the tendency that a crack occurs due to thermal stress and lack of strength of the stress releasing layer 80. Moreover, the thickness is greater than 0.6 mm does not contribute to the thermal stress releasing effect.

As shown in FIG. 13, test samples were prepared as follows:

Changing the laser welding condition varies the depth d4 of the weld layer 90 to change the ratio $\alpha$ of the sectional area at the depth d4 to the sectional area of the chip 50.

The test samples shown in FIG. 13 are subjected to the endurance test in the same way as the first embodiment to estimate the test samples.

Figure 14:
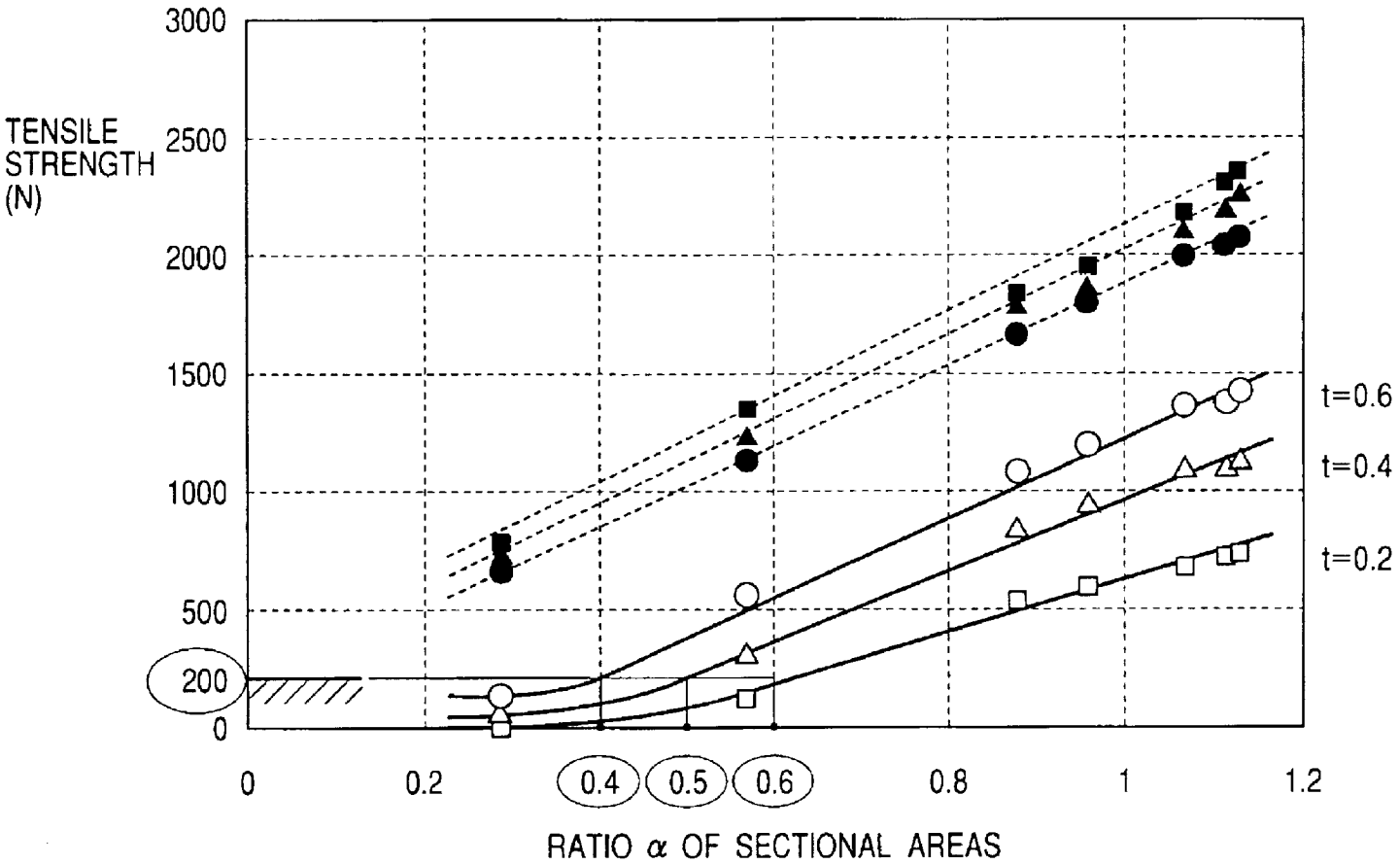
FIG. 14 is a graphical drawing showing tensile strength variation with respect to ratio of sectional areas from the estimation of the endurance test according to the second embodiment.

FIG. 14 is a graphical drawing showing tensile strength variation with respect to ratio $\alpha$ from the estimation result of the endurance test.

In FIG. 14, the square dots represent tensile strengths when the thickness t of the stress releasing layer 80 is 0.2 mm without the endurance test. Squares represent the tensile strengths when the thickness t of the stress releasing layer 80 is 0.2 mm after the endurance test. Triangle-shape dots represent the tensile strengths when the thickness t of the stress releasing layer 80 is 0.4 mm without the endurance test. Small triangles represent the tensile strengths when the thickness t is 0.4 mm after the endurance test. Square dots represent the tensile strengths when the thickness t of the stress releasing layer 80 is 0.6 mm without the endurance test. Circles represent tensile strengths after the endurance test when the thickness t of the modulation layer 80 is 0.6 mm.

As clearly shown in FIG. 14, the tensile strength after the endurance test increases with increase in the ratio α. This is because of thermal stress reduction effect due to decrease in the difference in the linear expansion coefficient and decrease in not welded portion at the connection portion. Moreover, the tensile strength after the endurance test increases as thickness of the stress releasing layer 80 increases. This is because the thermal stress reduction effect becomes high as the thickness of the stress releasing layer 80 increases up to 0.6 mm of the thickness of the stress releasing layer 80.

From the result shown in FIG. 14, the relation between the ratio α and the thickness t of the stress releasing layer 80 providing the tensile strength more than 200 N after the endurance test is obtained. For example, if the thickness t is 0.2 mm, the ratio α is 0.6. If the thickness t is 0.4 mm, the ratio α is 0.5. If the thickness t is 0.6 mm, the ratio α is 0.4.

Figure 15:
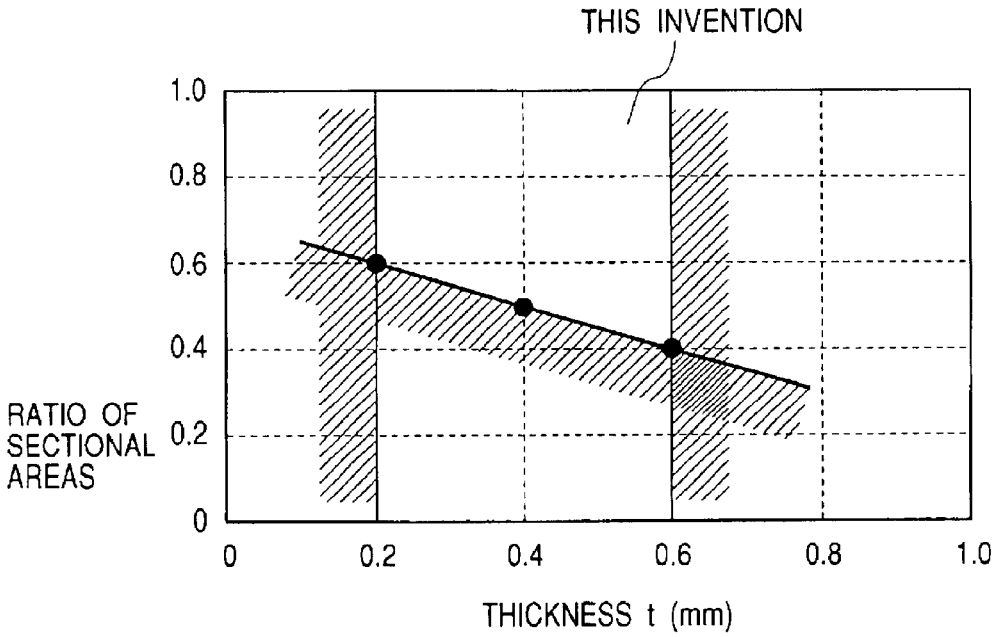
FIG. 15 is a graphical drawing representing the relation between the ratio of the sectional areas and the thickness of the stress releasing layer according to the second embodiment.

FIG. 15 is a graphical drawing representing this relation. From FIG. 15, the following equation (1) is given to provide the reliability in connection at the actual level, that is, the tensile strength more than 200 N.

$$\alpha \geqq (1.4-t)/2 \quad 0.2 \leqq t \leqq 0.6 (t \text{ in mm}) \tag{1}$$

From the above-mentioned study, it is favorable that the stress releasing layer 80 having a thickness equal to or greater than 0.2 mm and equal to or smaller than 0.6 mm is sandwiched and welded by laser, wherein the ratio α is equal to or greater than (1.4−t)/2 (at the zone between 0.2 and 0.6 of thickness t and above the line of α, (1.4−t)/2. This structure provides an actual reliability in connection between the chip 50 and the central electrode 30.

In this embodiment, as shown in FIG. 11B, the weld layer 90 is arranged between the base material and the chip 50. The weld layer 90 has a linear expansion coefficient between those of said base material 30 and the chip 50, so that the thermal stress between the chip 50 and the base material 30 can be reduced.

In FIG. 11A, the weld portion is arranged around said stress releasing layer. The weld portion is formed across the connection portion of the base material with the chip.

[Modifications]

There are modifications of this invention.

[First Modification]

FIGS. 16A to 16F are sectional side elevation views of the connection portion of the chip 50 and the central electrode 30. All of these modifications has a common feature that at least one weld layer is formed with full depth. That is, at least one of weld layers are formed in a circular plate. This first modification provides the same effect as the first embodiment.

Figure 16A:
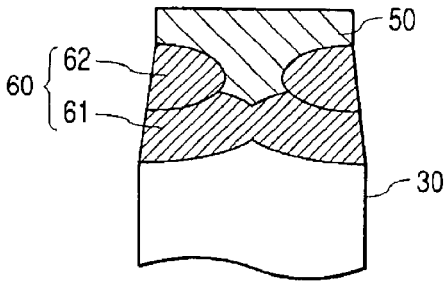
FIGS. 16A to 16F are sectional side elevation views of the tip portion of the central electrode according to a first modification.
Figure 16B:
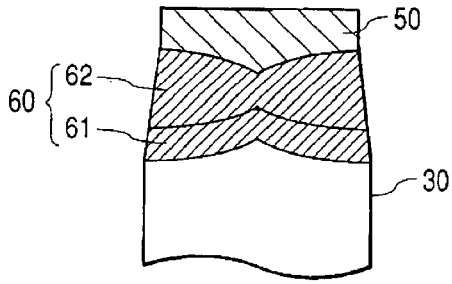
Figure 16C:
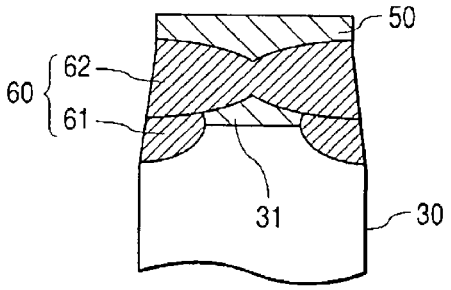
Figure 16D:
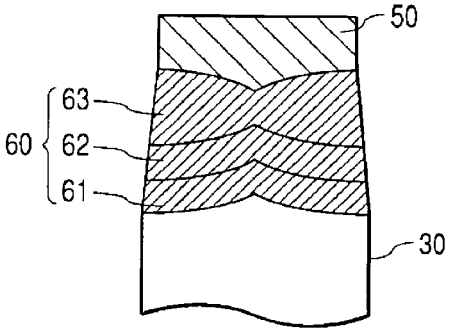
Figure 16E:
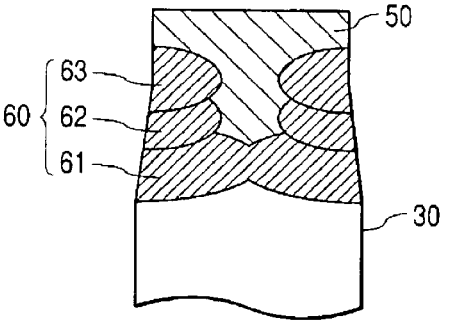
Figure 16F:
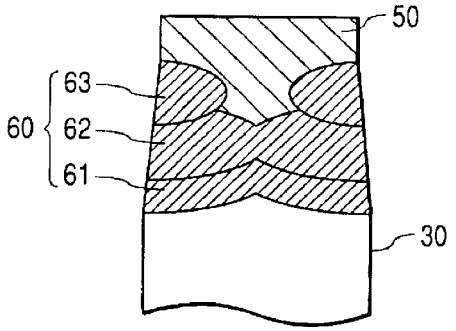

FIGS. 16A to 16C show two-weld-layer structures, wherein the two-weld-layer structure in FIG. 16A includes the first weld layer 61 formed at full depth (diameter of the central electrode 30). In the two-weld-layer structure in FIG. 16B, both of the first and second weld layers 61 and 62 are formed at the full depth. In the two-weld-layer structure in FIG. 16C, only the second weld layer is formed at the full depth. FIGS. 16D to 16F show three-weld-layer structures. In FIG. 16C, all weld layers are formed at the full depth. In FIG. 16E, only the first weld-layer is formed at the full depth. In FIG. 16F, only the first and second weld layers 61 and 62 are formed at the full depth.

[Second Modification]

Figure 17A:
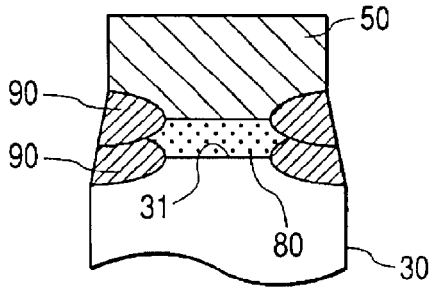
FIGS. 17A to 17C show a second modification for the second embodiment, wherein a plurality of weld layers are formed at the connection portion.
Figure 17B:
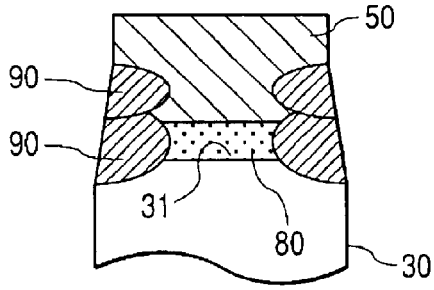
Figure 17C:
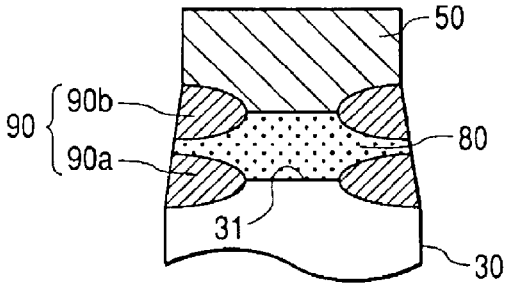

FIGS. 17A to 17C show a second modification for the second embodiment, wherein a plurality of weld layers are formed at the connection portion. This structure of the modification provides the thermal stress moderation effect with the stress releasing layer 80 in the same manner as the second embodiment. Moreover, according to the shapes of the weld layers 90, these structures may provide the same effect as the first embodiment.

In FIG. 17C, the weld portion includes first and second ring shape layers 90*a* and 90*b*, the first layer 90*a* is arranged between a portion of the end surface 31 of the base material 30 and the stress releasing layer 80 to fix the stress releasing layer 80 to the base material, the second ring shape layer 90*b* is arranged between the chip 50 and the stress releasing layer 80 to fix the chip 50 to the stress releasing layer 80. At the middle portion of the ring shape layers 90*a* and 90*b*, the base material 30 contacts with the stress releasing layer 80 and the stress releasing layer 80 and the chip 50.

[Third Modification]

Figure 18A:
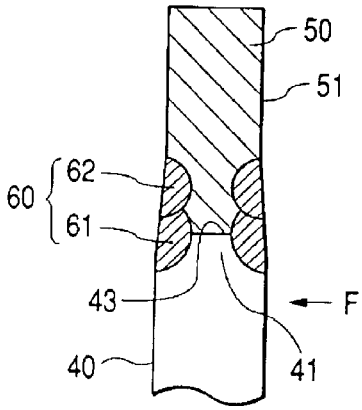
FIG. 18A is a sectional side elevation view in the case that a third modification is applied to the first embodiment.
Figure 18B:
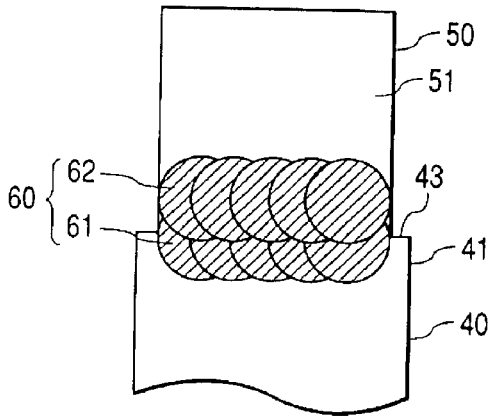
FIG. 18B show a side elevation view viewed from F in FIG. 18A.

The first and second embodiments are described with the example that the chip 50 is connected to the central electrode 30 by laser welding. However, these embodiments are applicable to the cases that the chip 50 is welded to the ground electrode 40 and that both the central electrode 30 and the ground electrodes are connected to the chips 30, respectively. FIGS. 18A and 18B show a third modification in which the chip 50 is connected to the ground electrode as the base material.

FIGS. 18A and 18B show that the first embodiment is applied to the ground electrode 40. FIG. 18B is a sectional side elevation view which is vied from F in FIG. 18A, wherein the hatching in elements 61 and 62 denotes only welded places but does not denote sectional areas.

The chip 50 having a rectangular parallelepiped post is fixed to an end surface (connection surface) 43 at one end 41 of the ground electrode 40 by laser welding. The chip 50 provides a spark discharge gap 70 (in FIG. 1) with the central electrode 30 or the chip 50 at the central electrode.

In the weld portion 60, weld layers 61 and 62 are successively formed such that the first weld layer 61 near the ground electrode 40 and the second layer 62 with overlap with the first weld layer 61 in the distance increasing direction from the central electrode 40.

With respect to section along the end surface 43 of the ground electrode 40, the sum of the sectional areas of the first weld layer 61 and the second weld layer 62 is equal to or more than 1.4 times the sectional area of the chip 50 (the sectional area perpendicular to the longitudinal direction of the chip 50).

Figure 18C:
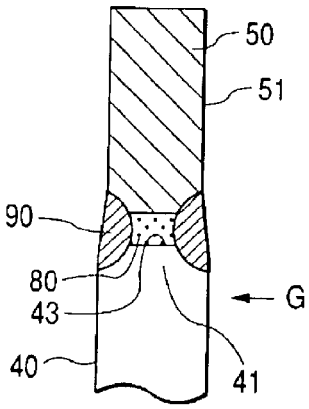
FIG. 18C is a sectional side elevation view in the case that a third modification is applied to the second embodiment.
Figure 18D:
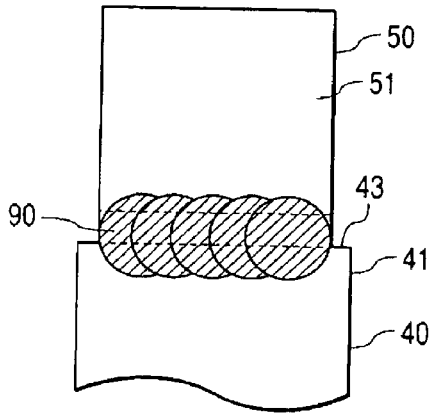
FIG. 18D is a side elevation view viewed from F in FIG. 19A.

FIGS. 18C and 18D show that the second embodiment is applied to the ground electrode 40. FIG. 18D is a sectional side elevation view which is view from G in FIG. 18C, wherein the hatching in the element 90 denotes only welded places but does not denote sectional areas.

Between the chip 50 and the end surface (connection surface) 43 of the ground electrode 40, the stress releasing layer 80 is provided of which linear expansion coefficient ranges between those of the chip 50 and the ground electrode 40. The chip 50, the stress releasing layer 80, and the ground electrode 40 are connected to each other with the weld layer 90 formed at interfaces between the chip 50 and the stress releasing layer 80 and between the stress releasing layer 80 and the ground electrode 40 (interface portion). In this case, the ground electrode 40 comprises a Ni-base alloy similar to the central electrode 30. The stress releasing layer 80 is made of the same material as the second embodiment.

The third modification shown in FIGS. 18A to 18D provides the same effects as the first and second embodiments. Moreover, the favorable structure, that is, the wedge structure, can be applied to the third modification.

Moreover, in this invention, the shapes of the central electrode 30, the ground electrode 40, and the chip 50 can be modified in designing. That is, in the spark plug of which base material (at least one of the central electrode 30 and the ground electrode 40) is connected to the chip 50 made of noble metal or a alloy including the noble metal by layer welding, this invention provides main features providing a higher strength in connection between the base material and the chip 50 by devising the structure of the weld portion and by providing the stress releasing layer, and the other portions can be modified.

What is claimed is:

1. A spark plug comprising:

a tubular housing;

a central bar electrode supported by said tubular housing in said tubular housing with electrical insulation therebetween; and a ground electrode extending from one end of said tubular housing;

a chip, arranged at an end surface of a base material which is at least one of said central bar electrode and said ground electrode, for spark discharge through said central bar electrode and said ground electrode, said chip including a noble metal; and a weld portion between said base material and said chip including first to $n^{th}$ weld layers formed by materials of said chip and said base material by laser welding to fix said chip to said base material, wherein said first to $n^{th}$ weld layers are successively arranged from a side of said base material in order of said first to $n^{th}$ weld layers in a distance increasing direction from said base material which is substantially perpendicular to said end surface, each of said first to $n^{th}$ weld layers has at least an overlap portion with a neighbor of said first to nm weld layers, a sum of a maximum first sectional area of said first layer and second sectional areas of said second to $n^{th}$ weld layers at said overlap portions is 1.4 times a third sectional area of said chip, said first, second, and third sectional areas are along said end surface, and n is a natural number more than one.

2. A spark plug as claimed in claim 1, wherein an $m^{th}$ weld layer has a maximum fourth sectional area along said end surface which is greater than said second sectional area of said mm weld layer at said overlap portion between said $m^{th}$ and $(m-1)^{th}$ weld layer, $2 \leqq m \leqq n$ and m is a natural number.

3. A spark plug as claimed in claim 1, wherein said chip includes Ir of more than 50% by weight.

4. A spark plug comprising:

a tubular housing;

a central bar electrode supported by said tubular housing in said tubular housing with electrical insulation therebetween;

a ground electrode extending from one end of said tubular housing;

a stress releasing layer, arranged on an end surface of a base material which is at least one of said central bar electrode and said ground electrode;

a chip, being arranged on said stress releasing layer and including a noble metal, for spark discharge through said central bar electrode and said ground electrode; and a weld portion formed between said base material and said chip with materials of said base material, said stress releasing layer, and said chip by laser welding to fix said chip to said base material, wherein a linear expansion coefficient of said stress releasing layer is between those of said base material and said chip, wherein a thickness t of said stress releasing layer is equal to or greater than 0.2 mm and equal to or smaller than 0.6 mm and $\alpha > (1.4-t)/2$ where a is a ratio of a maximum sectional area of said weld portion along said end surface to a sectional area of said chip along said end surface.

5. A spark plug as claimed in claim 4, wherein said chip includes Ir of more than 50% by weight.

6. A spark plug comprising:

a tubular housing;

a central bar electrode supported by said tubular housing in said tubular housing with electrical insulation therebetween; and a ground electrode extending from one end of said tubular housing;

a chip, arranged at an end surface of a base material which is at least one of said central bar electrode and said ground electrode, for electrode for spark discharge through said central bar electrode and said around electrode, said chip including a noble metal; and a weld portion between said base material and said chip including first to $n^{th}$ weld layers formed by materials of said chip and said base material by laser welding to fix said chip to said base material, wherein said first to $n^{th}$ weld avers are successively arranged from a side of said base material in order of said first to nth weld layers in a distance increasing direction from said base material which is substantially perpendicular to said end surface, each of said first to $n^{th}$ weld layers has at least an overlap portion with a neighbor of said first to $n^{th}$ weld layers, a sum of a maximum first sectional area of said first layer and second sectional areas of said second to $n^{th}$ weld layers at said overlap portions is 1.4 times a third sectional area of said chip, said first, second, and third sectional areas are along said end surface, and n is a natural number more than one wherein said weld portion includes first and second ring shape layers, said first layer is arranged between a portion of said end surface of said base material and said stress releasing layer to fix said stress releasing layer to said base material, said second ring shape layer is arranged between said chip and said stress releasing layer to fix said chip to said stress releasing layer.

7. A spark plug as claimed in claim 6, wherein said weld portion is arranged around said stress releasing layer.

* * * * *